US009561878B2

(12) United States Patent
Lee et al.

(10) Patent No.: US 9,561,878 B2
(45) Date of Patent: Feb. 7, 2017

(54) PACKING BOX OF PORTABLE DEVICE

(71) Applicants: SHINYOPTICS CORP., Tainan (TW); SHINWA TECHNOLOGY LIMITED, Tortola (BV)

(72) Inventors: Ming-Chun Lee, Tainan (TW); Xiang-Min Hu, Shenzhen (CN)

(73) Assignees: SHINYOPTICS CORP., Tainan (TW); SHINWA TECHNOLOGY LIMITED, Tortola (VG)

( * ) Notice: Subject to any disclaimer, the term of this patent is extended or adjusted under 35 U.S.C. 154(b) by 0 days.

(21) Appl. No.: 14/952,598

(22) Filed: Nov. 25, 2015

(65) Prior Publication Data

US 2016/0325875 A1 Nov. 10, 2016

(30) Foreign Application Priority Data

May 8, 2015 (TW) ..... 104207131 A

(51) Int. Cl.

| | |
|---|---|
| ***B65D 85/00*** | (2006.01) |
| ***B65D 5/50*** | (2006.01) |
| ***B65D 5/02*** | (2006.01) |
| ***B65D 5/42*** | (2006.01) |
| ***B65D 85/30*** | (2006.01) |

(52) U.S. Cl.

CPC ..... *B65D 5/5023* (2013.01); *B65D 5/02* (2013.01); *B65D 5/4266* (2013.01); *B65D 85/30* (2013.01)

(58) Field of Classification Search

CPC ..... B65D 5/5023; B65D 5/4266; B65D 5/02; B65D 85/30

USPC ..... 206/525, 320, 576, 701, 722, 723, 784

See application file for complete search history.

(56) References Cited

U.S. PATENT DOCUMENTS

| | | | | | |
|---|---|---|---|---|---|
| 1,366,309 | A * | 1/1921 | Brown | B65D 5/5023 | 206/68 |
| 2,829,778 | A * | 4/1958 | Carabet | A47L 9/0009 | 206/320 |
| 2,833,457 | A * | 5/1958 | Tyrseck | B65D 5/5023 | 206/45.29 |
| 3,172,530 | A * | 3/1965 | Grabosky | B65D 5/5023 | 206/256 |
| 3,438,482 | A * | 4/1969 | Hamilton | B65D 5/5014 | 206/320 |
| 5,251,760 | A * | 10/1993 | Smith | B65D 5/5028 | 206/583 |

(Continued)

*Primary Examiner* — Jacob K Ackun
*Assistant Examiner* — Jenine Pagan
(74) *Attorney, Agent, or Firm* — Muncy, Geissler, Olds & Lowe, P.C.

(57) ABSTRACT

A packing box of a portable device is provided, which includes a main plate body and a frame plate body. Plates, which are adjacent to the main plate body and the frame plate body, are respectively disposed with fold-lines; such that a first side plate of the main plate body overlaps a first bonding plate and a third side plate overlaps a second bonding plate to form an accommodating space.: first frame plate, a second frame plate and a third frame plate of the frame plate body are overlapped with one another, so that the first frame plate, the second fame plate and the third frame plate, which are overlapped with one another, separate the accommodating space through a third bounding plate of the frame plate body. When the main plate body and the frame plate body are flattened, the plates are parallel to one another and flat-shaped.

10 Claims, 18 Drawing Sheets

(56) References Cited

U.S. PATENT DOCUMENTS

| | | | | |
|---|---|---|---|---|
| 5,899,336 | A * | 5/1999 | Kataoka | B65D 5/5004 206/320 |
| 6,305,539 | B1 * | 10/2001 | Sanders, Jr. | B65D 5/6664 206/320 |
| 6,726,017 | B2 * | 4/2004 | Maresh | B65D 5/5035 206/594 |
| 7,036,716 | B2 * | 5/2006 | Kanamori | B65D 5/48018 206/738 |
| 7,097,042 | B2 * | 8/2006 | Hsu | B65D 5/4801 206/305 |
| 7,097,043 | B2 * | 8/2006 | Hsu | B65D 5/48018 206/320 |
| 7,172,109 | B2 * | 2/2007 | Kuenstler | B65D 5/48008 229/120.13 |
| 7,364,064 | B2 * | 4/2008 | Kanamori | B65D 5/48018 206/279 |
| 7,650,997 | B2 * | 1/2010 | Nago | B65D 5/5014 206/315.11 |
| 7,661,578 | B2 * | 2/2010 | Li | B65D 5/103 206/723 |
| 7,731,081 | B2 * | 6/2010 | Liang | B65D 5/5023 229/117.13 |
| 7,878,326 | B2 * | 2/2011 | Andre | B65D 25/10 206/320 |
| 2006/0266672 | A1 * | 11/2006 | Young | B65D 77/0433 206/776 |
| 2009/0057379 | A1 * | 3/2009 | Schulhof | B65D 5/0254 229/75 |
| 2016/0114965 | A1 * | 4/2016 | Huang | B65D 85/30 206/472 |
| 2016/0214758 | A1 * | 7/2016 | Yamamura | B65D 5/6608 |
| 2016/0214760 | A1 * | 7/2016 | Takeuchi | B65D 5/3621 |

* cited by examiner

PACKING BOX OF PORTABLE DEVICE

CROSS-REFERENCE TO RELATED APPLICATION

This application claims the benefit of Taiwan Patent Application No. 104207131, filed on May 8, 2015, in the Taiwan Intellectual Property Office, the disclosure of which is incorporated herein in its entirety by reference.

BACKGROUND OF THE INVENTION

1. Field of the Invention

The present disclosure generally relates to a packing box of a portable device, in particular to a packing box of a portable device which is feasible for being manufactured as a head mounted display.

2. Description of the Related Art

Recently, the head mounted display has been developing as an image display for displaying virtual reality, and is able to be Wore on user's head. The applied field thereof becomes widely. The head mounted display shows the display components or a portable device such as a smart phone in front of the user's eyes via the manner of a glass or a helmet, and then the display components or the portable device project different virtual images towards the user's eyes so as to produce the image with 3D virtual reality.

In addition, the current packing box of :a portable device is various in terms of the aspects. Basically, it includes a box and an accommodating space for accommodating a portable device. However, the conventional packing box of a portable device is only provided with the buffering power for prevent the contents from being damaged and designed as a disposable merchandise. Consequently, it produces the amount of trash and is uneconomically to the resource consumption and the ecological environment.

SUMMARY OF THE INVENTION

In view of the aforementioned technical problems, the primary objective of the present disclosure provides a packing box of a portable device which is feasible for being manufactured as a head mounted display. The head mounted display can be combined with a packing box of a portable device of the present disclosure, such that the packing box of the portable device can he manufactured as a head mounted display with a repeat usage. Hence, the packing box of the portable device is not only given a new function, but also beneficial to the decrease of resource consumption.

The present disclosure provides a packing box of a portable device, including a main plate body and a frame plate body. The main plate body may include a bottom plate having a first end edge, a second end edge opposing to the first end edge, a first side edge perpendicular to the first end edge and a second side edge opposing to the first side edge; a first side plate protrudingto be formed at the first end edge of the bottom plate; a second side plate, a top plate and a first bonding plate protruding to be formed at the second end edge of the bottom plate sequentially; a third side plate protruding to be formed at the first side edge of the bottom plate; a fourth side plate, a connecting plate, a fifth side plate and a second bonding plate protruding, to be formed at the second side edge of the bottom plate sequentially.

The frame plate body may include a third bonding plate, a first frame plate, a second frame plate and a third frame plate protruding to be formed at a first end edge of the connecting plate sequentially. The plates, which are adjacent to one another, may be respectively disposed with fold-lines, such that the first side plate overlaps the first bonding plate and the third Side plate overlaps the second bonding plate to form an accommodating space. The first frame plate, the second frame plate and the third frame plate may be overlapped with one another, so that the third bonding plate separates the first frame plate, the second fame plate and the third frame plate which are overlapped with one another from the accommodating space. When the main plate body and the frame plate body are flattened, the plates are parallel to one another and flat-shaped.

Preferably, the first frame plate, the second frame plate and the third frame plate respectively may have two windows, such that a display image of a portable device can be observed through the windows.

Preferably, the top plate may be disposed with cutting lines for cutting a part of the top plate and the first bonding plate adjacent to the top plate.

Preferably, the bottom plate may be disposed with cutting lines fur cutting a part of the bottom plate and the first side plate adjacent to the first end edge. Preferably, the cutting lines of the bottom line and a second end edge of the connecting plate may be parabolic substantially.

Preferably, the second side plate may be disposed with cutting lines for cutting a part of the second side plate.

Preferably, the third side plate, the fourth side plate and the top plate may further be respectively disposed with a perforation for perforating a headband.

Preferably, the third bonding plate may be disposed with fold-lines for folding a part of the third bonding plate, such that the first frame plate, the second frame plate and the third frame plate which are overlapped are perpendicular to the connecting plate.

In addition, a packing box of a portable device of the present disclosure may further include a bracket disposed at one end of the accommodating space which is separated for placing a portable device, and a support member disposed at the other end of the accommodating space which is separated for placing accessories of the portable device.

After removing the portable device out of the packing box, the user can cut a part of the top plate, the first bonding plate adjacent to the top plate, a part of the bottom plate, the first side plate adjacent to the first end edge of the bottom plate and a part of the second side plate along the cutting lines of the top plate the bottom plate and the second side plate, and then can perforate the headband through the perforations of the third side plate., the fourth side plate and the top plate. Next the portable device is placed at one end of the accommodating space so as to be manufactured as the head mounted display. Afterwards, the portable device projects different virtual images to the user's eyes through the two windows of the frame plate body, such that the user car see the image with 3D virtual reality.

The detailed structure, operating principle and effects of the present invention will now be described in more details hereinafter with reference to the accompanying drawings that show various embodiments of the invention as follows.

DETAILED DESCRIPTION OF THE PREFERRED EMBODIMENTS

Figure 1A:
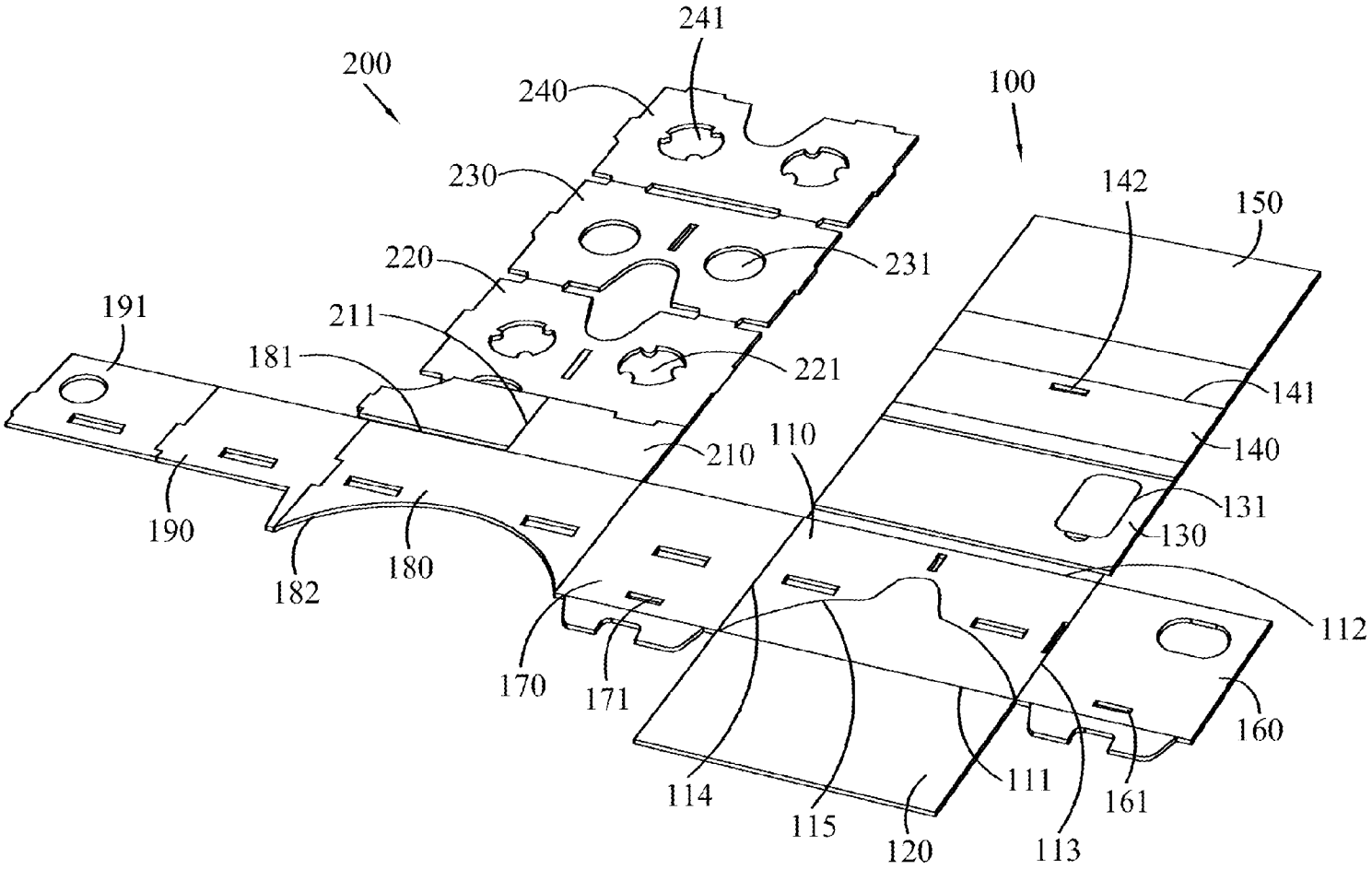
FIGS. 1A to 1G are the schematic diagrams showing the process of folding a packing box of a portable device of the present disclosure.
Figure 1B:
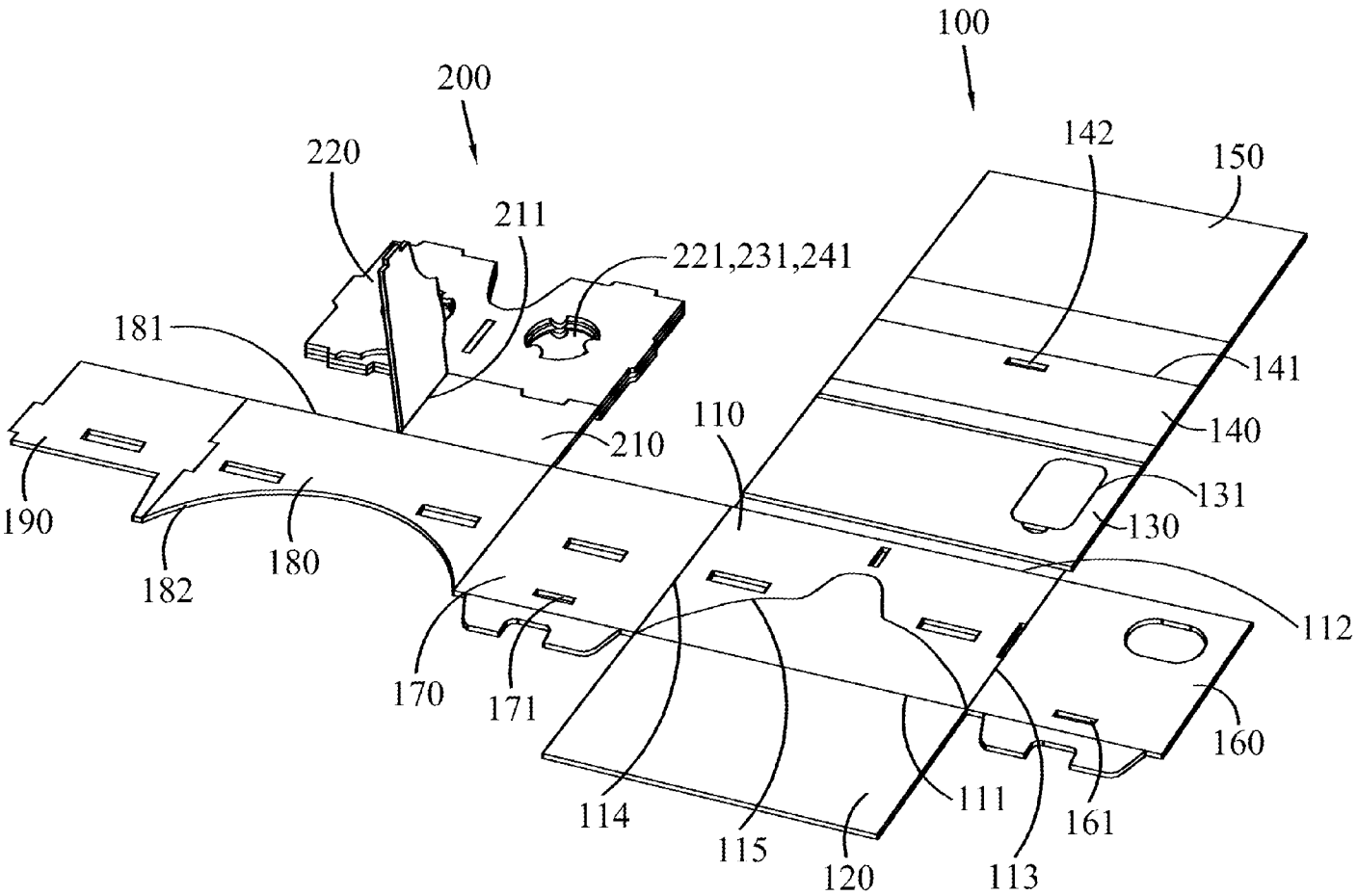

Hereinafter, embodiments of the present disclosure will be described in detail with reference to the accompanying drawings so that those skilled in the art to which the present disclosure pertains can realize the present disclosure. As those Skilled in the art would realize, the described embodiments may be modified in various different ways, all without departing, from the spirit or scope of the present disclosure.

Please refer to FIGS. 1A to 1G and FIGS. 2A to 2C which are the schematic diagrams showing the process of folding a packing box of a portable device of the present disclosure, and the three-dimensional diagrams showing the completion of folding a packing box of a portable device of the present disclosure, respectively.

A packing box of a portable device of the present disclosure includes a main plate body 100 and a frame plate body 200 which are made of flexible plates such as a paper plate, a plastic plate, a foam plate, a resin plate, and so on. However, the present disclosure is not limited thereto.

The main plate body 100 is a cruciform substantially, and includes a bottom plate 11.0, a first side plate 120, a second side plate 130, a top plate 140, a first bonding plate 150, a third side plate 160, a fourth side plate 170, a connecting plate 180, a fifth side plate 190 and a second bonding plate 191.

Here, the bottom plate 100 has a first end edge 111, a second end edge 112 opposing to the first end edge 111, a first side edge 113 perpendicular to the first end edge 111 and a second side edge 114 opposing to the first side edge 113; a first side plate 120 protruding to be formed at the first end edge 111 of the bottom plate 110; a second side plate 130, a top plate 140 and a first bonding plate 150 protruding to be formed at the second end edge 112 of the bottom plate 110 sequentially; a third side plate 160 protruding to be formed at the first side edge 113 of the bottom plate 110; a fourth side plate 170, a connecting plate 1.80, a fifth side plate 190 and a second bonding plate 191 protruding to be formed at the second side edge 114 of the bottom plate 110 sequentially.

The frame plate body 200 is a rectangular shape substantially, and includes a third bonding plate 21.0, a first frame plate 220, a second frame plate 230 and a third frame plate 240 protruding to be formed at the first end edge 181 of the connecting plate 180, sequentially. Here, the first frame plate 220, the second frame plate 230 and the third frame plate 240 have two windows 221, 231, 241, respectively. The third bonding plate 210 is disposed with fold-lines 211 for folding a part of the third bonding plate 210.

The plates, which are adjacent to main plate body 100 and the frame plate body 200, are disposed with fold-lines therebetween. For example, the bottom plate 110 of the main plate body 100 and the first side plate 120 Which is adjacent to the bottom plate 110 are disposed with fold-lines therebetween, so that the first side plate 120 can be folded opposing to the bottom plate 110 to facilitate the folded first side plate 120 perpendicular to the bottom plate 110.

As shown in FIG. 18, a packing box of a portable device of the present disclosure is folded from the frame plate body 200. The first frame plate 220, the second frame plate 230 and the third flume plate 240 are overlapped with one another, and then a part of the third bonding plate 210 is folded upward along the cutting lines 211 of the third bonding plate 210. Afterwards, the second bonding plate 191 is folded downward and towards the right, so as to overlap the second bonding plate 191 and the fifth side plate 190.

Figure 1C:
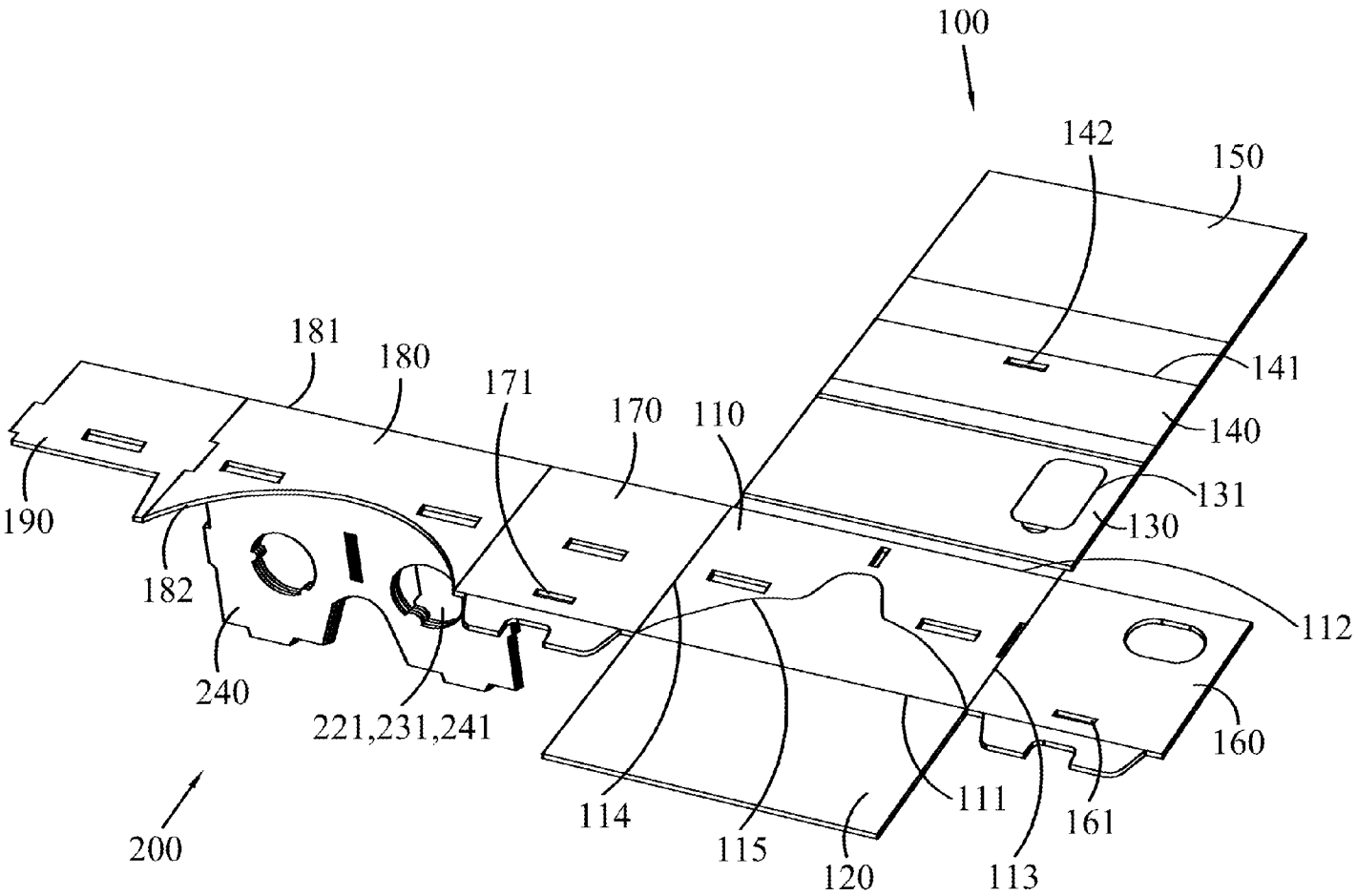

As shown in FIG. 1C, the first frame plate 220, the second frame plate 230 and the third frame plate 240, which are overlapped, are folded toward one part of the third bonding plate 210 which is folded, such that the first frame plate 220, the second frame plate 230 and the third frame plate 240, which are overlapped, are perpendicular to a part of the third bonding plate 210 which is folded. Next, the other part of the third bonding plate 210 is folded inward so that the first frame plate 220, the second frame plate 230 and the third frame plate 240, which are overlapped, are perpendicular to the connecting plate 180.

Figure 1D:
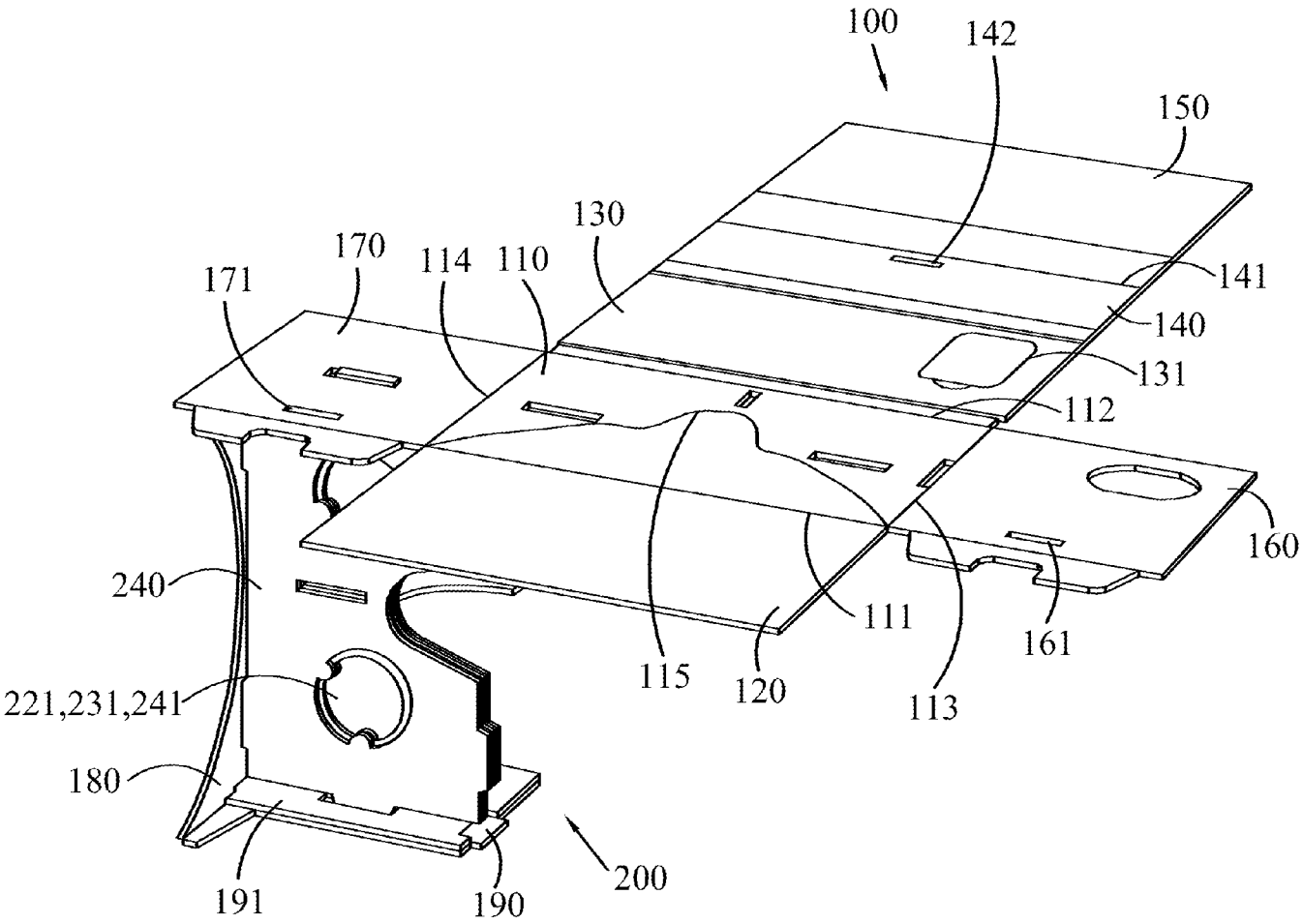

As shown in FIG. 1D, the fifth side plate 190 is folded downward and the connecting plate 180 is folded downward sequentially, so that the first frame plate 220, the second frame plate 230 and the third frame plate 240, which are overlapped, are perpendicular to the fourth side plate 170, and are perpendicular to the second bonding plate 191 and the fifth side plate 190 which are overlapped each other. Thus the fourth side plate 170, and the second bonding plate 191 and the fifth side plate 190 which are overlapped are respectively at two sides of the overlapped frame plate body 200.

Figure 1E:
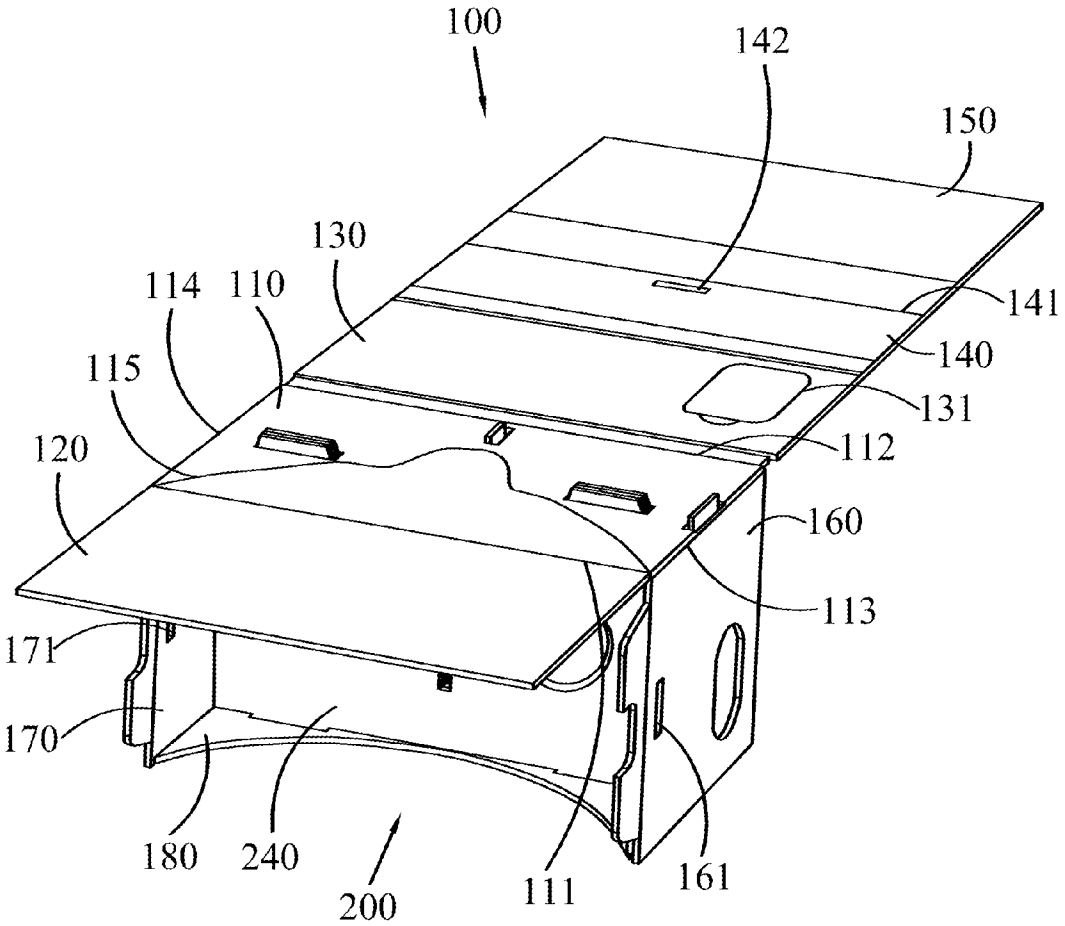
Figure 1F:
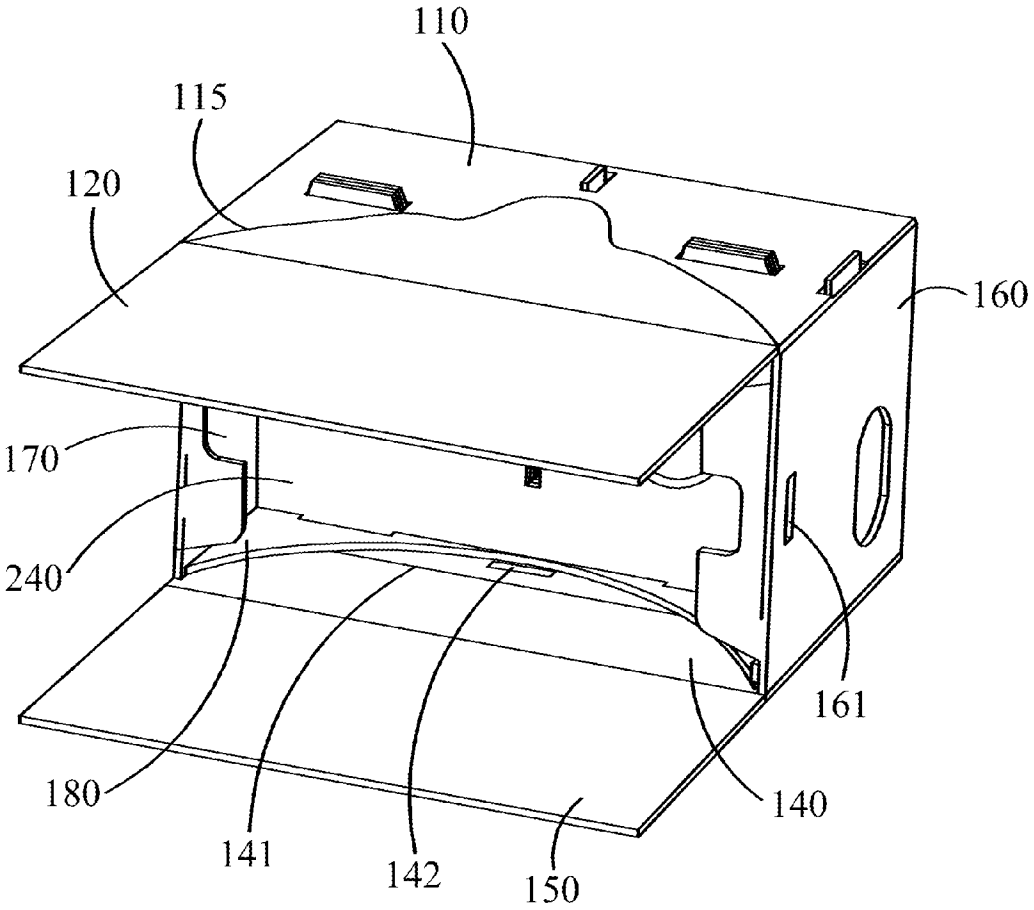
Figure 1G:
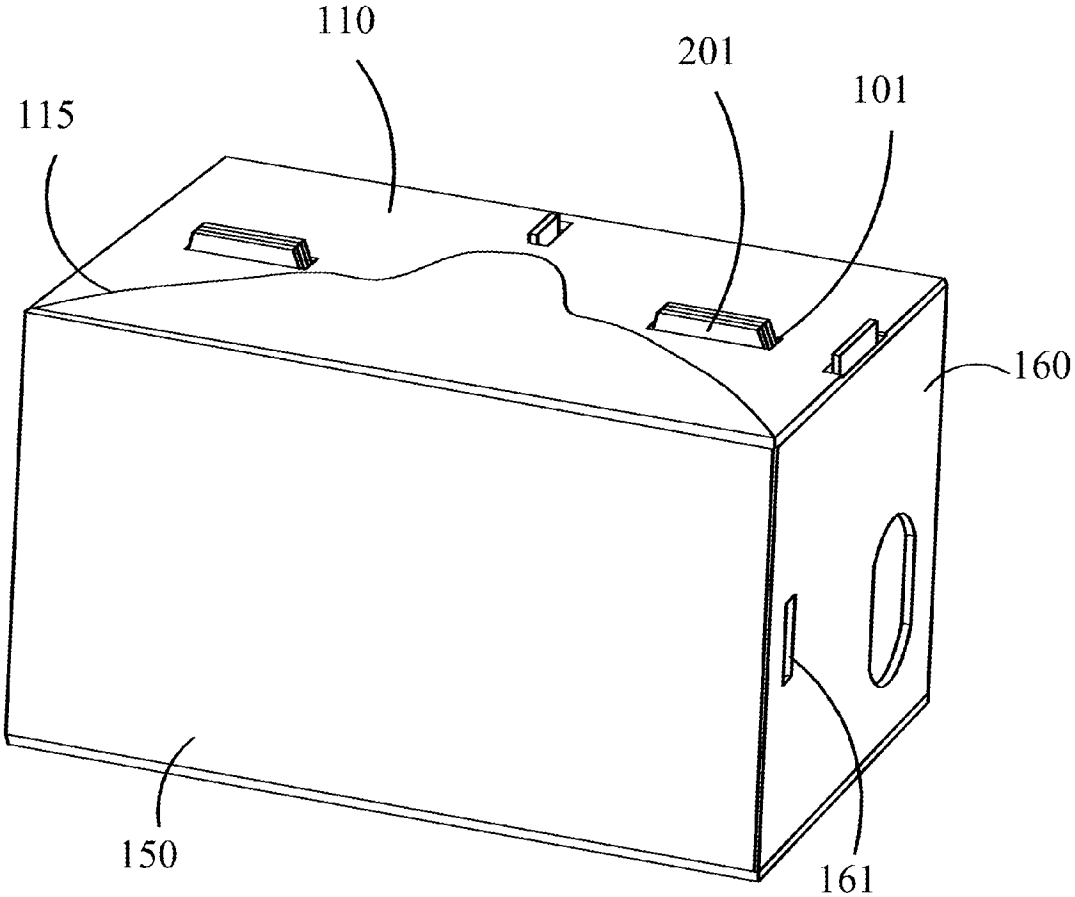
Figure 2A:
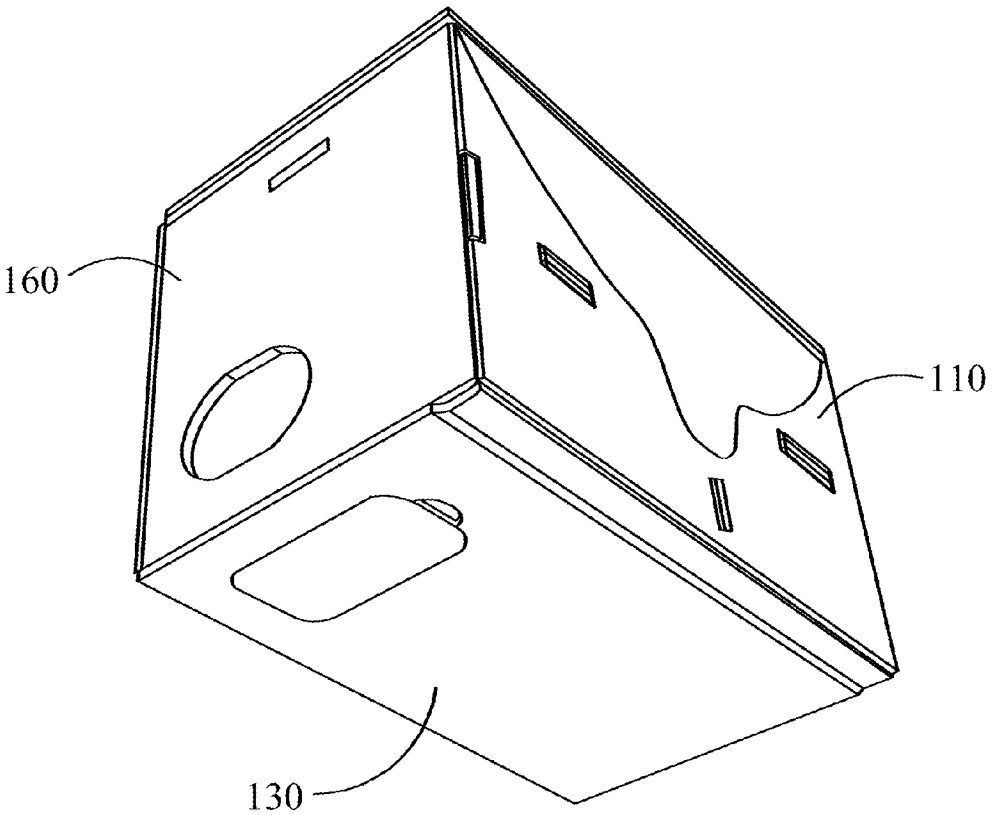
FIGS. 2A to 2C are the three-dimensional diagrams showing the completion of folding a packing box of a portable device of the present disclosure.
Figure 2B:
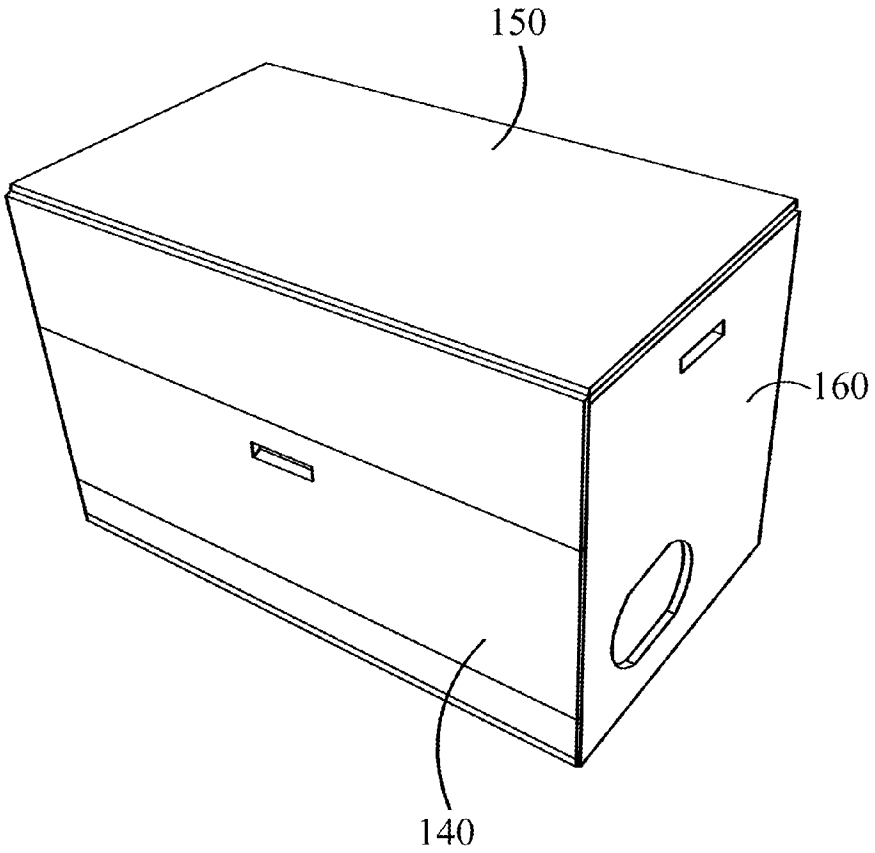
Figure 2C:
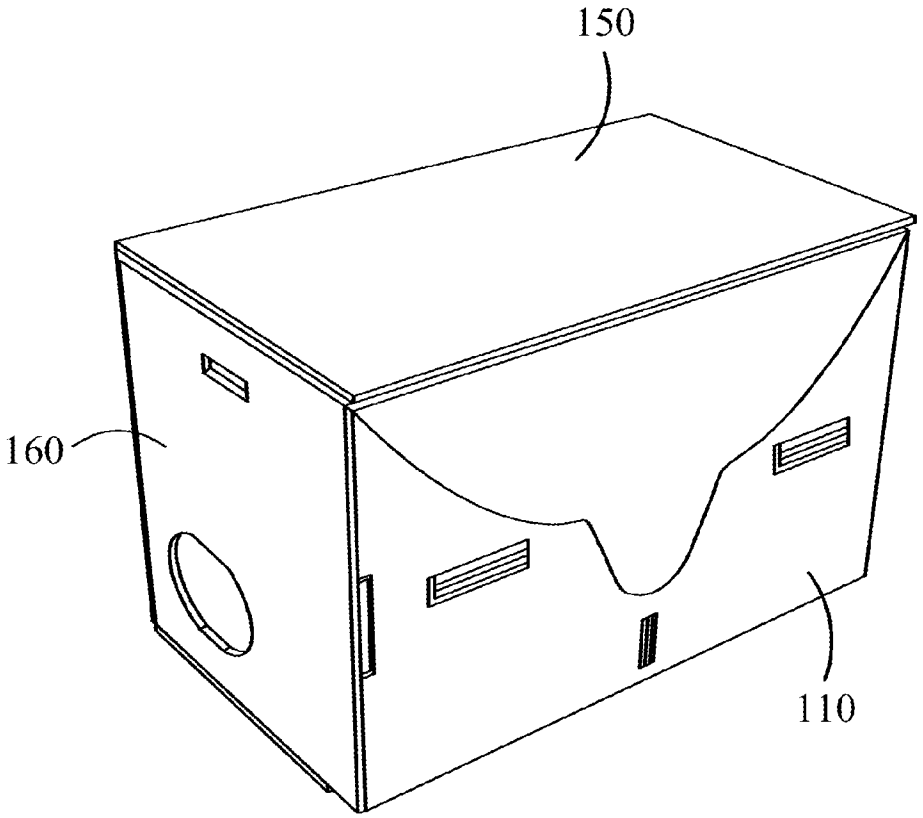

As shown in FIG. 1E, the third side plate 160 and the fourth side plate 170 are folded downward respectively, so that the first frame plate 220, the second frame plate 230 and the third frame plate 240, which are overlapped, are perpendicular to the bottom plate 110. As shown in FIGS. 1F and 1G, the second side plate 130, the top plate 140 and the first bonding plate 150 are folded and then the first side plate 120 is folded downward, so that the first side plate 120 and the first bonding plate 1.50 overlap with each other so as to form a packing box of a portable device shown in FIGS. 2A to 2C. Here, the frame plate body 200, which is folded, separates an accommodating space formed of the main plate body 100 which is folded. When the main plate body 100 and the frame plate body 200 are flattened, the plates are parallel to one another and fiat-shaped.

As shown in FIG. 1G, the plates of the frame plate body 200 further includes an insert 201, and the plates of the main plate body 100 further include a slot 101 in which the insert 201 can insert therein, so that the structural strength and stability of a packing box of a portable device of the present disclosure are promoted.

Figure 3:
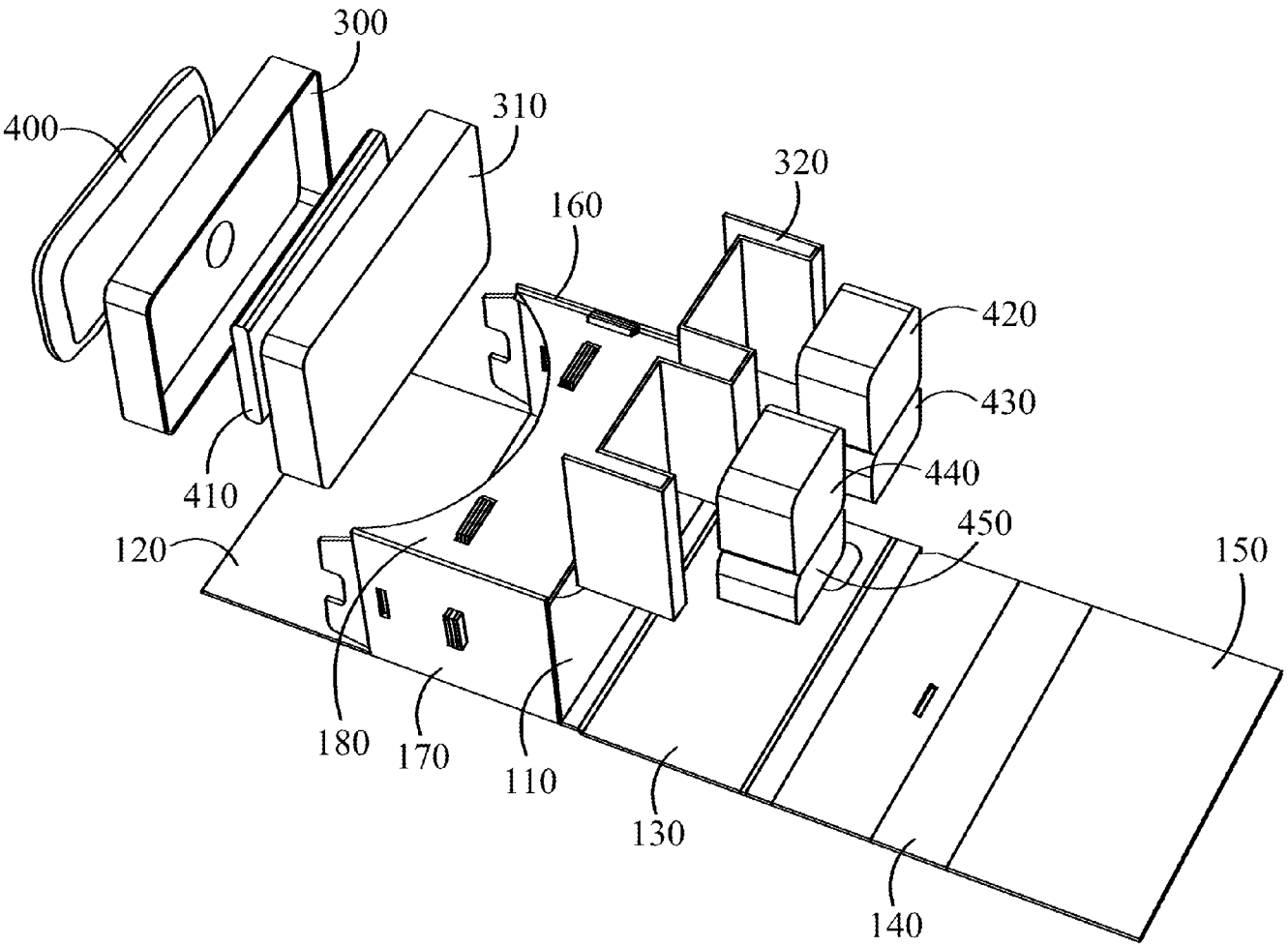
FIG. 3 is an explosion diagram of a packing box of a portable device of the present disclosure.
Figure 4A:
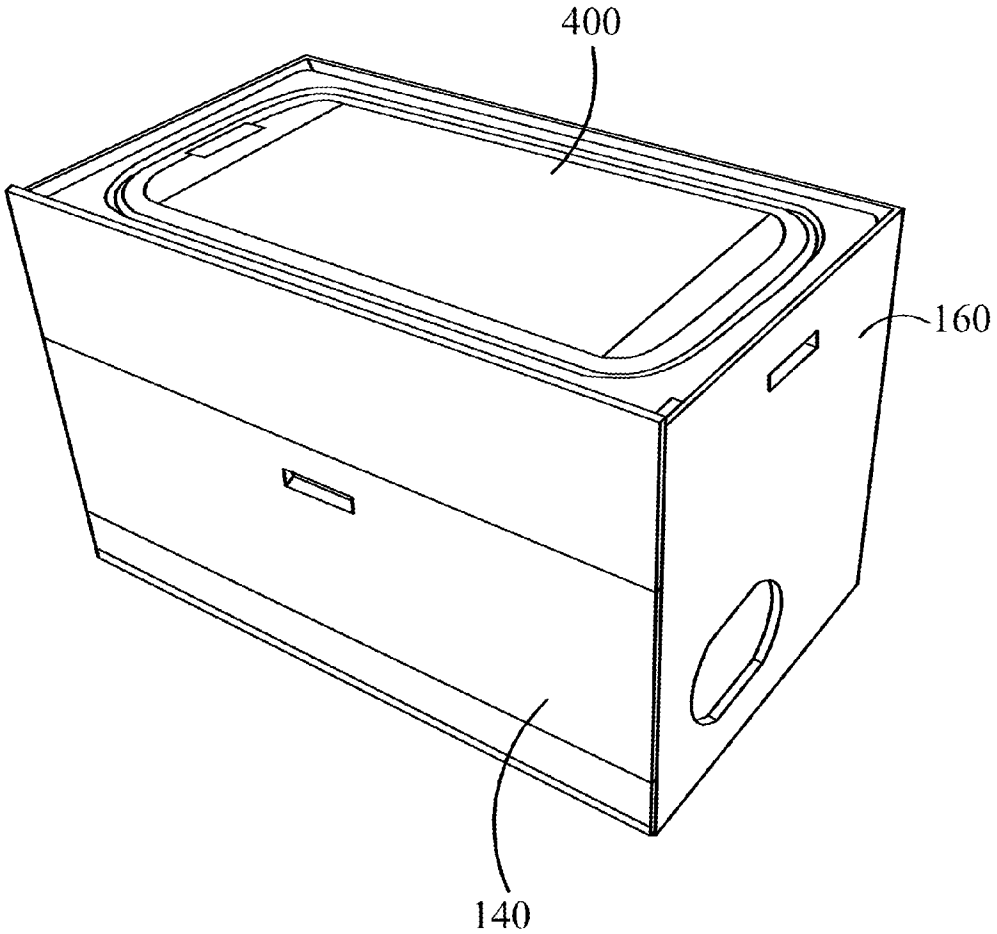
FIGS. 4A to 4C are the three-dimensional diagrams showing a packing box of a portable device of the present disclosure.
Figure 4B:
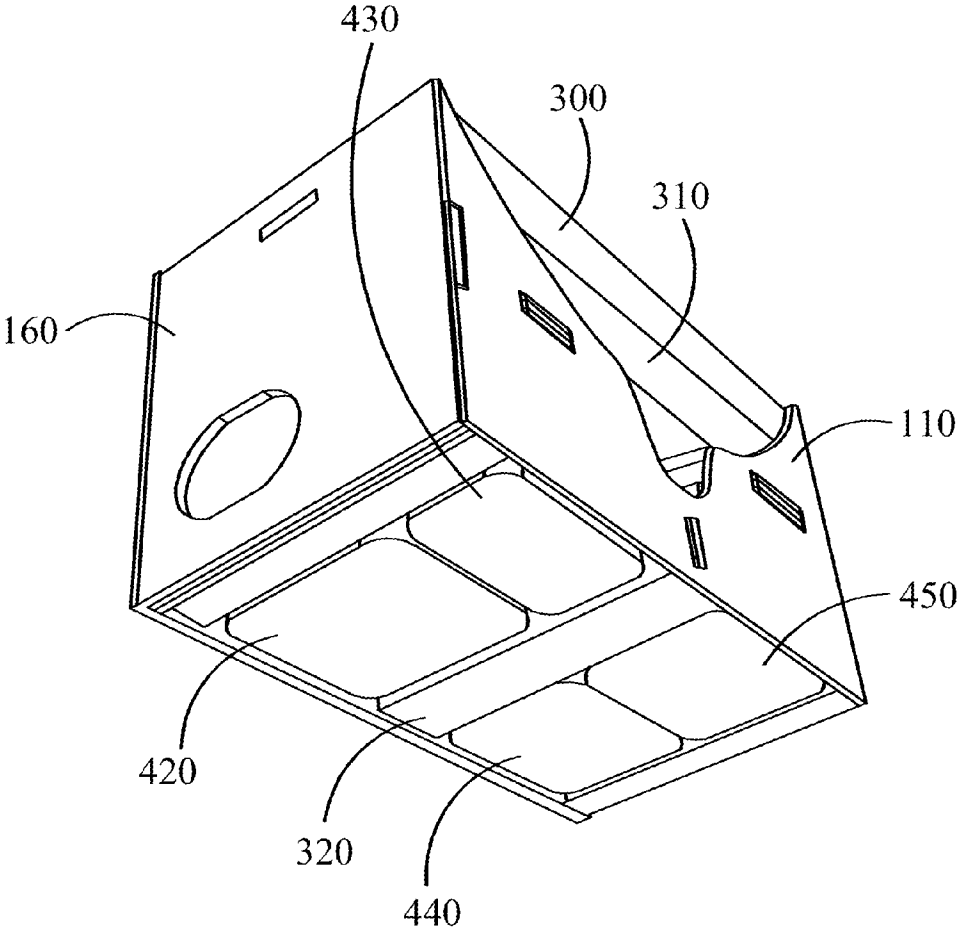
Figure 4C:
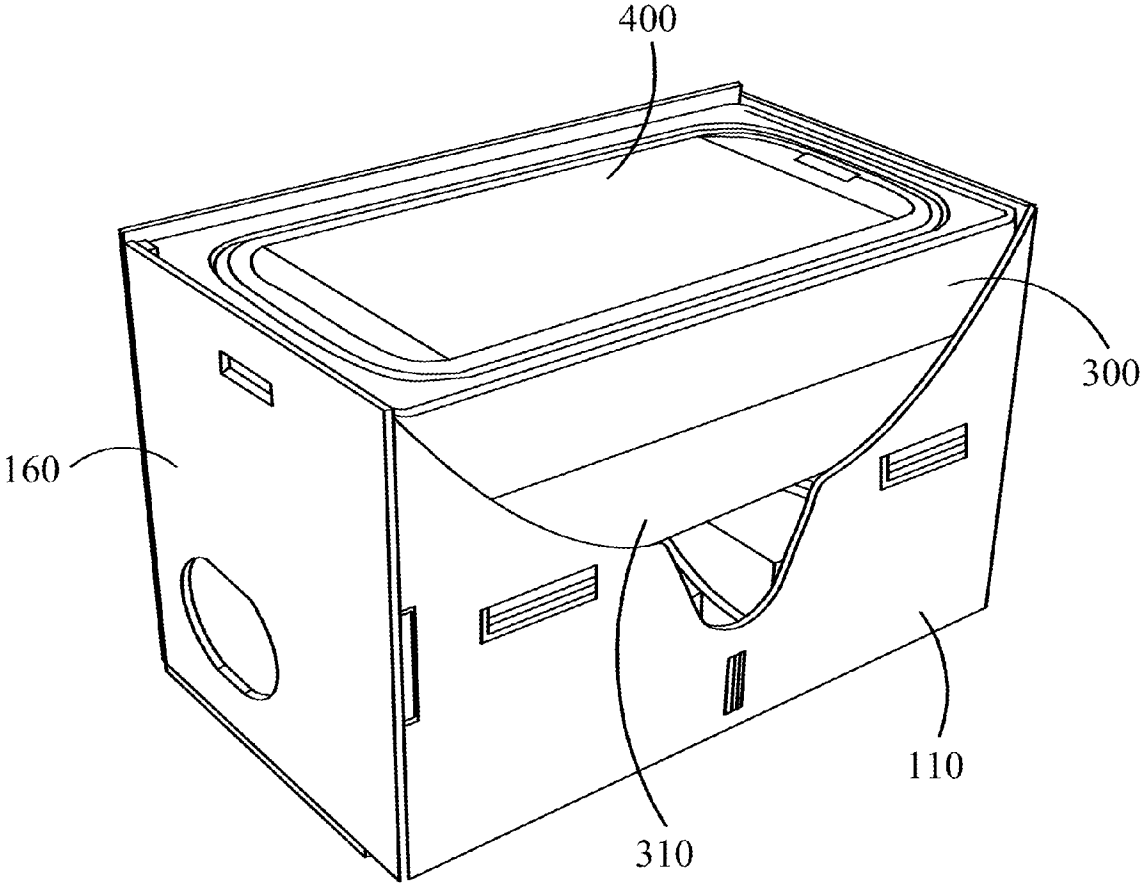
Figure 5A:
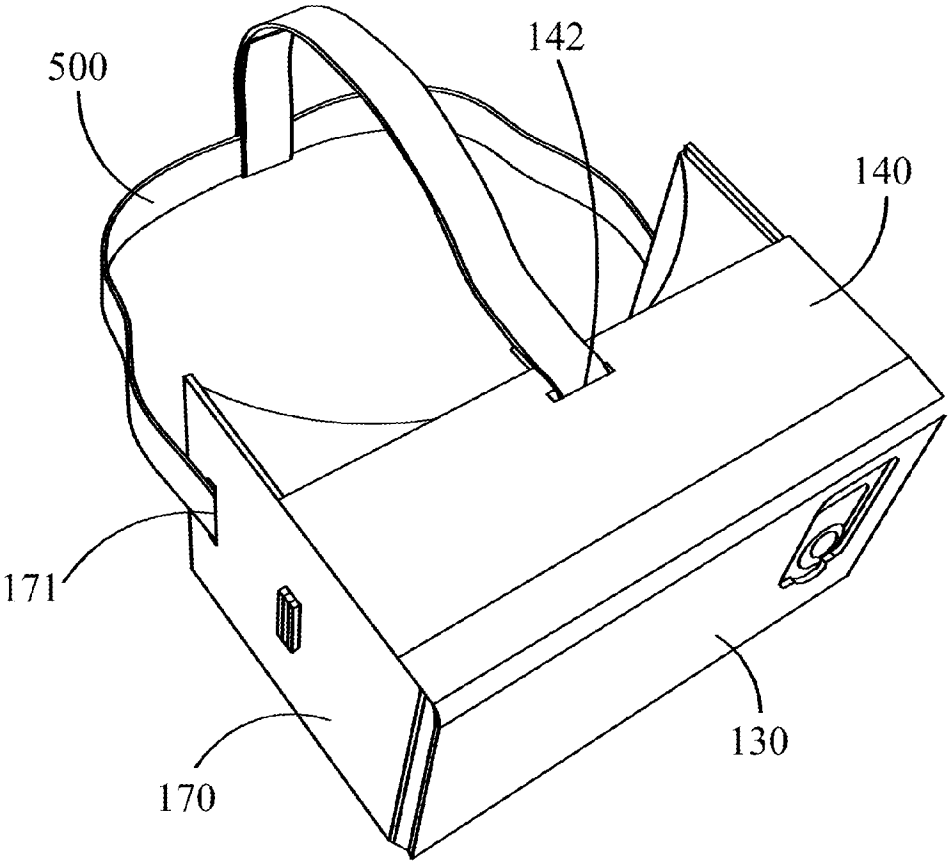
FIGS. 5A to 5D are the three-dimensional diagrams showing a head mounted display manufactured by a packing box of a portable device of the present disclosure.
Figure 5B:
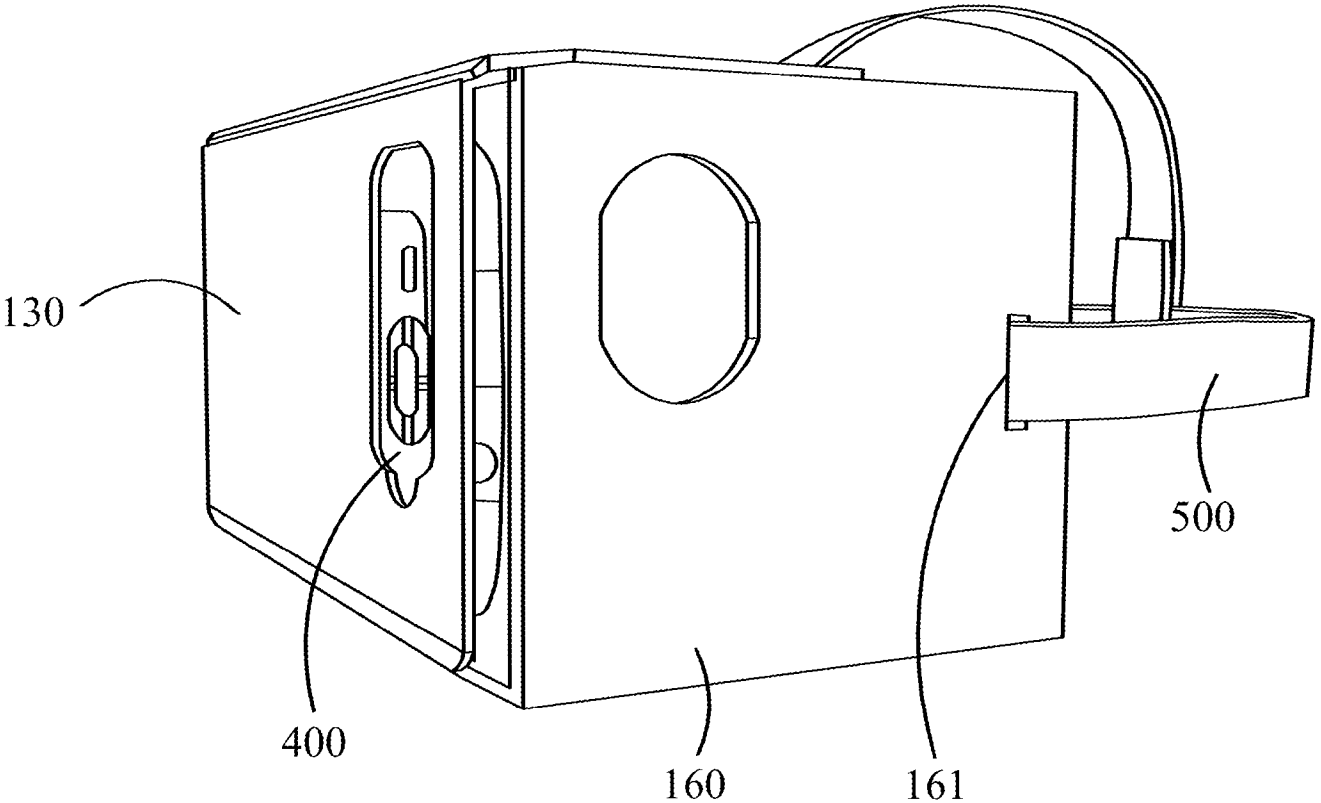
Figure 5C:
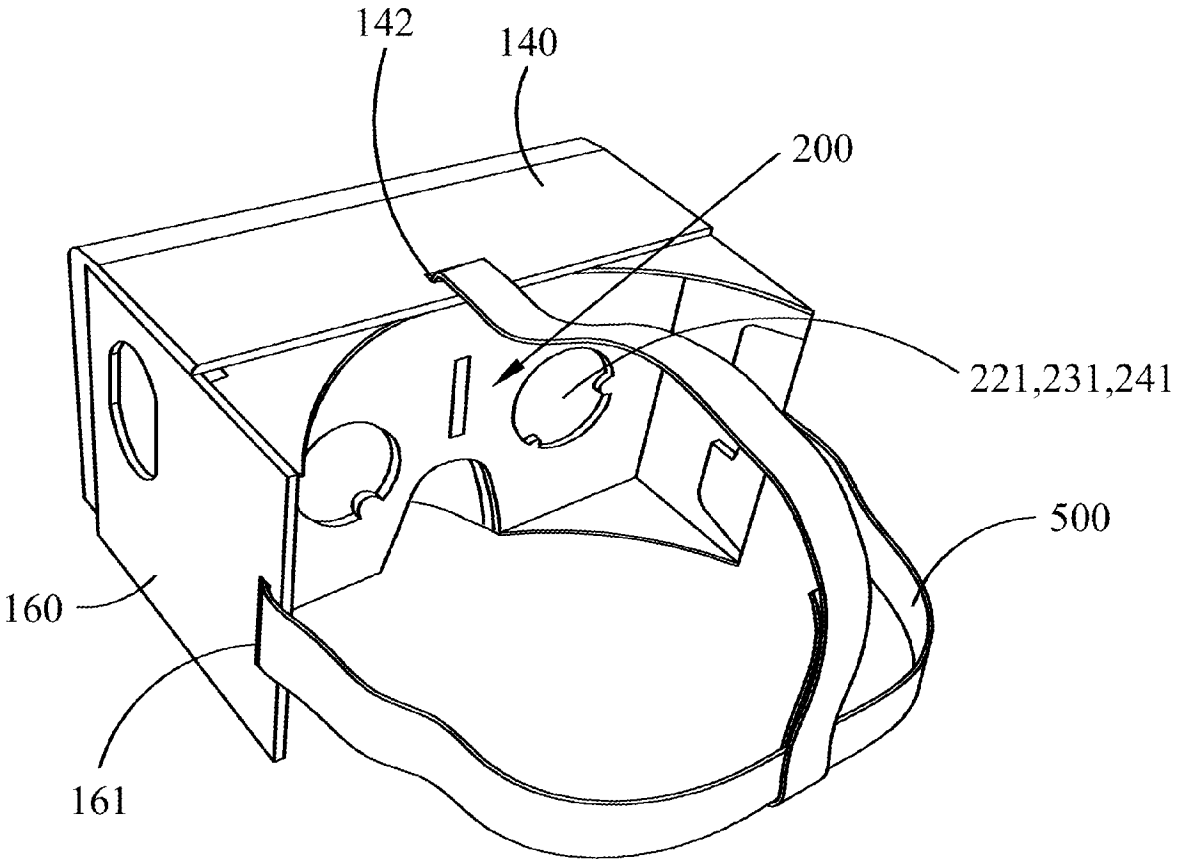
Figure 5D:
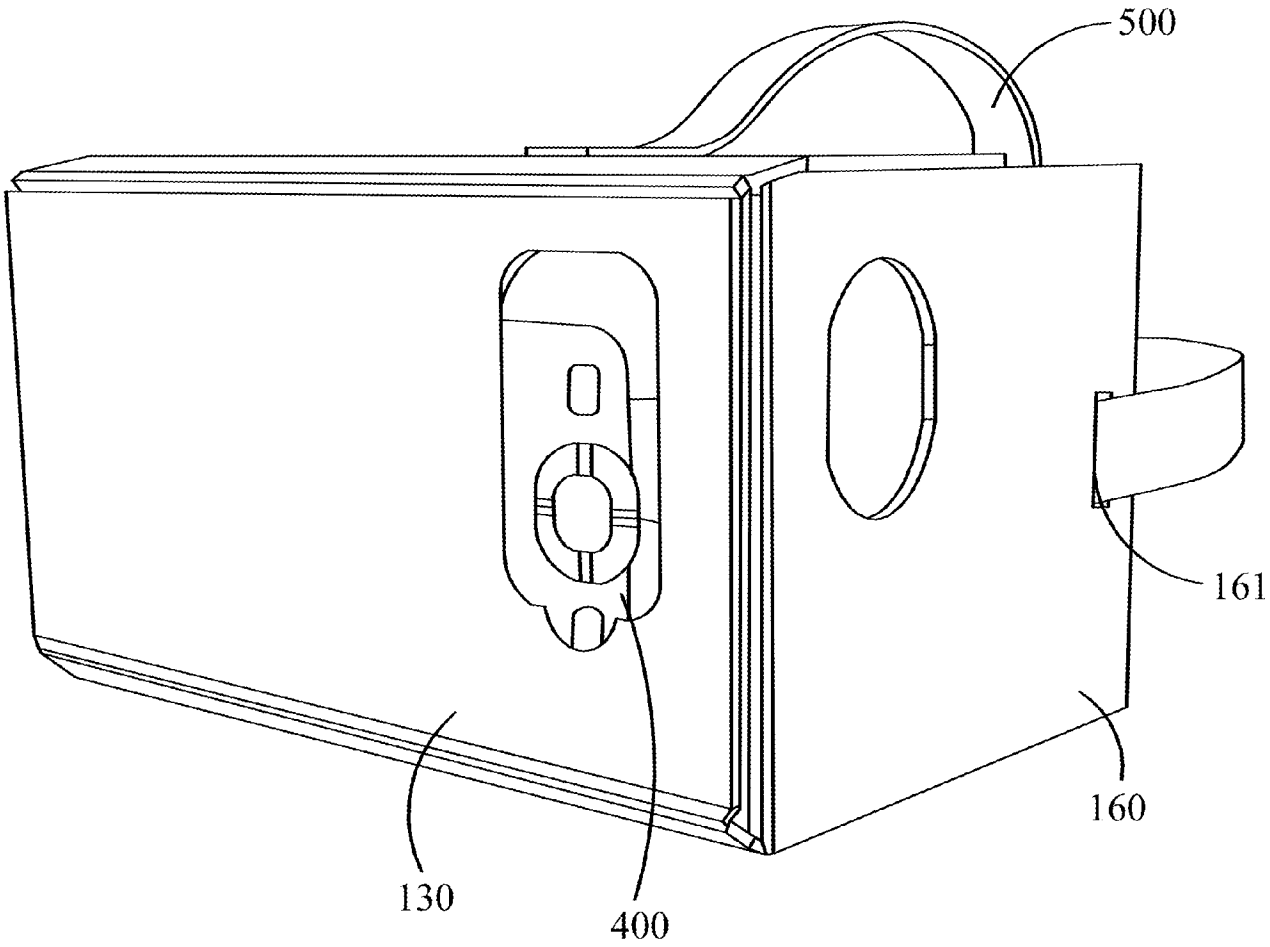

Please refer to FIGS. 1A to 1G. FIG. 3 and FIGS. 4A to 4C. FIG. 3 is an explosion diagram of a packing box of a portable device of the present disclosure, and FIGS. 4A to 4C are the three-dimensional diagrams showing a packing box of a portable device of the present disclosure.

A packing box of a portable device of the present disclosure further includes a first bracket 300, a second bracket 310 and a support member 320. The first bracket 300 and the second bracket 310 are disposed at one end of the accommodating space formed of the main plate body 100. Which is folded. The support member 320 is disposed at the other end of the accommodating space formed of the main plate body 100 which is folded. The frame plate body 200, which is folded, separates the first bracket 300, the second bracket 310 and the support member 320.

The first bracket 300 is applied to place a portable device 400 such as a smart phone, a personal digital assistant, a digital camera, an electronic book, a digital photo frame, and electronic dictionary, and so on. The second bracket 310 is applied to place a first accessory 410 of the portable device 400 such as the specification, user manual, and so on. The support member 320 is applied to place a second accessory 420, a third accessory 430, a fourth accessory 440 and a fifth accessory 450 such as a charger, wires, headset, headband, and so on. However, the present disclosure is not limited thereto.

In addition, for the sake of showing, the relative positions of each accessory of the portable device 400 in a packing box of a portable device of the present disclosure clearly, the first side plate 120, the second side plate 120, the first bonding plate 150 and a part of the bottom plate 100 shown in FIGS. 4A to 4C are removed.

Please refer to FIGS. 1A to 1G and 5A to 5D. FIGS. 5A to 5D are the three-dimensional diagrams showing a head mounted display manufactured by a packing box of a portable device of the present disclosure.

The bottom plate 110, the top plate 140 and the second side plate 130 of the main plate body 100 are further disposed with cutting lines 115, 141, 131, and the third side plate 160, the fourth side plate 170 and the top plate 140 of the main plate body 100 are further respectively disposed with perforations 161, 171, 142.

When using a packing box of a portable device of the present disclosure to manufacture a head mounted display, the user can cut a part of the bottom plate 110 and the first side plate 120 adjacent to the first end edge 111 of the bottom plate 110 along the cutting lines 115 of the bottom plate 110, and cut a part of the top plate 140 and the first bonding plate 150 adjacent to the top plate 140 along the cutting lines 141 of the top plate 140, and then cut a part of the second side plate 130 along the cutting lines 131 of the second side plate 130.

Next, a headband 500 is perforated through the perforations 161, 171, 148 of the third side plate 160, the fourth side plate 170 and the top plate 140, and the portable device 400 is placed between the frame plate body 200 and the second side plate 130. Screen of the portable device 400 may face two windows 221, 231, 241 of the frame plate body 200, and lens of the portable device 400 may face the second side plate 130 and is exposed at a part of the second side plate 130 which is cut.

Furthermore, the cutting lines 115 of the bottom plate 115 and the second end edge 182 of the connecting plate 180 are parabolic substantially, such that the head mounted display matches the facial lines of the user when being wore.

In addition, a portable device 400 respectively projects different virtual images towards eyes of the user through the two windows 221, 231, 241 of the frame plate body 200, so that the user can see the image with 3D virtual reality.

As a result; a packing box of a portable device of the present disclosure can be effectively combined with a head mounted display, such that a packing box of a portable device of the present disclosure is capable of being manufactured as the head mounted display with a repeat usage. So, the packing box of the portable device is not only given a new function, but also beneficial to the decrease of resource consumption. Hereby, the industrial practicality of a packing box of a portable device of the present disclosure is promoted.

While the means of specific embodiments in present disclosure has been described by reference drawings, numerous modifications and variations could be made thereto by those skilled in the art without departing from the scope and spirit of the disclosure set forth in the claims. The modifications and variations should in a range limited by the specification of the present disclosure.

What is claimed is:

1. A packing box of a portable device, comprising:

a main plate body, comprising:

a bottom plate having a first end edge, a second end edge opposing to the first end edge, a first side edge perpendicular to the first end edge and a second side edge opposing to the first side edge;

a first side plate protruding to be formed at the first end edge of the bottom plate;

a second side plate, a top plate and a first bonding plate protruding to be formed at the second end edge of the bottom plate sequentially;

a third side plate protruding to be formed at the first side edge of the bottom plate;

a fourth side plate, a connecting plate, a fifth side plate and a second bonding plate protruding to be formed at the second side edge of the bottom plate sequentially;

a frame plate body comprising a third bonding plate, a first frame plate, a second frame plate and a third frame plate protruding to be formed at a first end edge of the connecting plate sequentially;

wherein, the plates, which are adjacent to one another, are respectively disposed with fold-lines, such that the first side plate overlaps the first bonding plate and the third side plate overlaps the second bonding plate to form an accommodating space, and wherein, the first frame plate, the second frame plate and the third frame plate are overlapped with one another, so that the third bonding plate separates the first frame plate, the second fame plate and the third frame plate which are overlapped with one another from the accommodating space, and when the main plate body and the frame plate body are flattened, the plates are parallel to one another and flat-shaped.

2. The packing box: of a portable device of claim 1, wherein the first frame plate, the second frame plate and the third frame plate respectively have two windows, such that a display image of a portable device can be observed through the windows.

3. The packing box of a portable device of claim 1, wherein the top plate is disposed with cutting lines for cutting a part of the top plate and the first bonding plate adjacent to the top plate.

4. The packing box of a portable device of claim 1, wherein the bottom plate is disposed with cutting lines for cutting a part of the bottom plate and the first side plate adjacent to the first end edge.

5. The packing box of a portable device of claim 4, wherein the cutting lines of the bottom line and a second end edge of the connecting plate are parabolic substantially.

6. The packing box of a portable device of claim 1, wherein the second side plate is disposed with cutting lines for cutting a part of the second side plate.

7. The packing box of a portable device of claim 1, wherein the third side plate, the fourth side plate and the top plate are further respectively disposed with a perforation for perforating a headband.

8. The packing box of a portable device of claim 1 wherein the third bonding plate is disposed with fold-lines for folding a part of the third bonding plate, such that the first frame plate, the second frame plate and the third frame plate which are overlapped are perpendicular to the connecting, plate.

9. The packing box of a portable device of claim 1., further comprising a bracket disposed at one end of the accommodating space which is separated for placing a portable device.

10. The packing box of a portable device of claim 9, further comprising a support member disposed at the other end of the accommodating, space which is separated for placing accessories of the portable device.

* * * * *